United States Patent [19]

Wakasugi et al.

[11] Patent Number: 4,661,791

[45] Date of Patent: Apr. 28, 1987

[54] REED SWITCH WITH HIGH INSULATION

[75] Inventors: Tomio Wakasugi, Hino; Akinori Maeda, Hachioji, both of Japan

[73] Assignee: Hewlett-Packard Company, Palo Alto, Calif.

[21] Appl. No.: 732,464

[22] Filed: May 8, 1985

[30] Foreign Application Priority Data

May 29, 1984 [JP] Japan ..... 59-79239[U]

[51] Int. Cl.[4] ..... H01H 1/66; H01H 51/00

[52] U.S. Cl. ..... 335/151; 200/144 B; 335/154

[58] Field of Search ..... 335/151, 152, 153, 154; 200/144 B; 174/50.51, 209

[56] References Cited

U.S. PATENT DOCUMENTS 684,094 10/1901 Potter ..... 200/144 B

FOREIGN PATENT DOCUMENTS 131743 of 1982 Japan .

*Primary Examiner*—Harold Broome

*Attorney, Agent, or Firm*—Douglas L. Weller

[57] ABSTRACT

A reed switch with high insulation for a very low current measurement system is provided. The reed switch is embodied by coating over its glass-made surface with fluoroplastics materials in order to reduce the leakage current on the surface.

2 Claims, 1 Drawing Figure

REED SWITCH WITH HIGH INSULATION

BACKGROUND

The present invention relates to a reed switch with high insulation for a very low current measurement system.

Previously, Takuo Banno has indicated in Japanese Utility Model Laid-Open No. 57-131743, which has been assigned to Yokogawa-Hewlett-Packard Co., Ltd., that there is an unfavorable effect on signals caused by insulation resistance of switches, especially when measuring very low amplitude signals. Therefore, in the above-named Japanese Utility Model, Banno has proposed a particular combination of multiple switches to avoid such effects. When a reed switch is used as said switch, the resistivity of its insulation may generally be only approximately $10^9\Omega$ in a non-hostile environment, because of the leakage current on its glass-made surface. For very low current measurement, such order of insulation resistance is too low for measurement as is also suggested by Banno in the aforementioned Japanese Utility Model.

Improved insulation resistance of a reed switch could be achieved by washing or silicon coating. However, such treatment may not be effective for very low current measurement under high temperature and humid conditions in which its insulation resistance could still be less than $10^{12}\Omega$.

A primary object of the present invention is to provide a reed switch with high insulation which can be used as matrix switches and scanners for very low current measurement even under high temperature and humid conditions.

SUMMARY OF THE INVENTION

According to the present invention, a reed switch with high insulation, which can be effectively used for very low current measurement (e.g., a switch matrix), is provided by coating over its glass-made surface with fluoroplastics materials.

The reed switch of this invention has obtained excellent characteristics as regards insulated resistance, offset current, dielectric absorption, etc., under high temperature and humid conditions and also furnishes an increased number of channels in measurement, especially for very low currents.

DETAILED DESCRIPTION OF THE INVENTION

Figure 1:
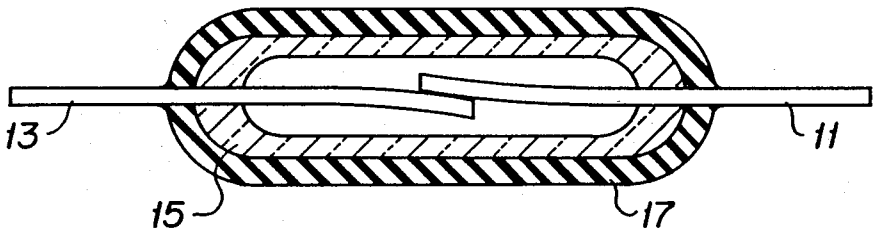
FIG. 1 is a cross-sectional view of a reed switch with high insulation in the embodiment of the present invention.

Our intensive experiments have revealed that it is the surface condition of the glass-made wall of a reed switch that dominates the resistivity of its insulation. The present invention provides an improved reed switch coated with fluorocarbon polymer over the surface thereof.

FIG. 1 is a cross-sectional view of a reed switch according to the preferred embodiment of this invention. The surface of the glass tube 15 of a reed switch that contains wire leads 11 and 13 is sufficiently washed, and then fully coated with fluorocarbon polymer 17 over the outer surface as shown in FIG. 1. Such fluorocarbon polymer coating material can be chosen appropriately from those commercially available in the market. Coating method can be done by various methods as spraying, dipping, etc. As a result of the evaluation of the insulator resistivity of many reed switches embodied by this invention, the average resistivity of the insulator was measured at $2\times10^{16}\Omega$ ($9\times10^{15}\Omega$ was a minimum) at a temperature of 23° C. and humidity at 50%. At a temperature of 40° C. and humidity at 70%, the average resistivity of the insulation was found to be $5\times10^{15}\Omega$ ($1.8\times10^{15}\Omega$ was a minimum) which showed very small deterioration of resistivity of the insulation. Moisture resistivity for offset current and dielectric absorption were also improved.

These improvements can also result in more efficient circuit design. For instance, in Japanese Utility Model Laid Open No. 57-131743, mentioned above, the number of required prior art reed switches with high insulation per output channels may be determined by the formula: Number of Switches=((Number of Input Channels)$\times3+1$). However, when the reed switches of this invention are used, the number of required switches with high insulation is reduced to the number of input channels.

Accordingly, when a measurement with a resolution of 1fA ($10^{-15}$ A) is performed using the switches in the prior art, the number of channels available is limited to as few as 10. However, using the reed switches with the high insulation of this invention, a scanner can be built with the channel number more than 1000.

We claim:

1. A reed switch with high insulation comprising:

a pair of conducting leads for selectively making contact; and an enclosure for enclosing said pair of leads, an outer surface of said enclosure being coated with a fluoroplastic, said fluoroplastic providing high electrical insulation between said pair of conducting leads.

2. The reed switch with high insulation as set forth in claim 1, wherein said enclosure is made of glass.

* * * * *